US012729611B2

(12) United States Patent
Wosaibei et al.

(10) Patent No.: US 12,729,611 B2
(45) Date of Patent: Sep. 8, 2026

(54) SYSTEM AND METHOD FOR FLOW-LINE CIRCULATION

(71) Applicant: Saudi Arabian Oil Company, Dhahran (SA)

(72) Inventors: Abdullah Wosaibei, Al-Ahsa (SA); Hasan M. Jassem, Hofuf (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/033,933

(22) Filed: Jan. 22, 2025

(65) Prior Publication Data

US 2026/0210218 A1 Jul. 23, 2026

(51) Int. Cl.
*E21B 43/12* (2006.01)

(52) U.S. Cl.
CPC ..... *E21B 43/12* (2013.01)

(58) Field of Classification Search
CPC ..... E21B 43/12
See application file for complete search history.

(56) References Cited

U.S. PATENT DOCUMENTS

| | | | | |
|---|---|---|---|---|
| 11,542,785 | B2 | 1/2023 | Abdelhamid et al. | |
| 2005/0092523 | A1* | 5/2005 | McCaskill | E21B 21/08 175/218 |
| 2017/0268327 | A1* | 9/2017 | Eiman | E21B 43/12 |
| 2021/0332652 | A1* | 10/2021 | Muraikhi | E21B 47/06 |

* cited by examiner

*Primary Examiner* — Crystal J Lee
(74) *Attorney, Agent, or Firm* — Dinsmore & Shohl LLP

(57) ABSTRACT

Systems and methods for managing flow of well fluids in a well are provided. The well comprises a wellhead and a wellbore having a tubing and an annulus. The systems include a flow-back path that the tubing fluidly connected to the annulus, a flow line extending from the wellhead to an injection source, and a recirculation line extending from the flow line to the wellhead. The methods include transporting a portion of well fluids from the tubing through the flow-back path into the annulus.

17 Claims, 5 Drawing Sheets

SYSTEM AND METHOD FOR FLOW-LINE CIRCULATION

TECHNICAL FIELD

The present disclosure generally relates to managing flow of well fluids in a well and, more specifically, to recirculating flow-back fluids.

BACKGROUND

Conventional practice for managing excess flow-back fluids generally involves transporting the flow-back fluids to an external disposal system such as a nearby waste pit. The conventional practice may not be strategic to field pressure support requirements. For example, maintaining reservoir pressure is crucial for efficient extraction of hydrocarbons; however, transporting flow-back fluids into an external disposal system could cause the reservoir pressure to drop, leading to decreased production rates.

Furthermore, the flow-back fluids often contain hazardous materials including radioactive substances, highly acidic chemicals, degraded pipeline materials, and high-temperature fluids. Thus, the conventional practice is environmental unfriendly and could pose serious safety risks. While pipelines, such as temporal Reinforced Thermoplastic Pipelines (RTP), may be installed to transport flow-back fluids to a nearby disposal system, installing such pipelines is time-consuming, labor-intensive, and costly.

Accordingly, needs exist for cost-effective, environmental friendly methods and systems to strategically manage well fluids with reduced safety concerns.

SUMMARY

Embodiments disclosed and described herein address these needs by transporting flow-back fluids from a well, through a flow-back path, into a tubing-casing annulus of the well. Transporting the flow-back fluids back into the well substantially reduces the fluid discharge during well operations and allow the flow-back fluids to be recycled for, such as, field pressure maintenance purpose.

In accordance with one or more embodiments of the present disclosure, methods of managing flow of well fluids in a well are provided. The well comprises a wellhead and a wellbore. The wellbore comprises a tubing and a first casing surrounding the tubing and defining a tubing-first casing annulus. The provided methods comprise measuring pressures in the wellhead, the tubing, or the tubing-first casing annulus; and transporting a portion of well fluids from the tubing through a flow-back path into the tubing-first casing annulus when a pressure in the wellhead or the tubing is greater than the pressure in the tubing-first casing annulus or when the pressure in the wellhead or the tubing exceeds a predetermined pressure-relief value. The transporting of well fluids reduces the pressure in the wellhead or the tubing to a level at or below the predetermined pressure-relief value. The flow-back path comprises the tubing fluidly connected to the tubing-first casing annulus, a flow line extending from the wellhead to an injection source, and a recirculation line extending from the flow line to the wellhead.

In accordance with one or more embodiments of the present disclosure, systems for managing flow of well fluids in a well are provided. The well comprises a wellhead and a wellbore, the wellbore comprising a tubing, a first casing surrounding the tubing and defining a tubing-first casing annulus. The systems include a flow-back path. The flow-back path comprises the tubing fluidly connected to the tubing-first casing annulus; a flow line extending from the wellhead to an injection source; a recirculation line extending from the flow line to the wellhead. The flow-back path is operable to transport a portion of well fluids from the tubing through the flow-back path into the tubing-first casing annulus when a pressure in the wellhead or the tubing is greater than the pressure in the tubing-first casing annulus or when the pressure in the wellhead or the tubing exceeds a predetermined pressure-relief value.

Additional features and advantages of the methods of and systems for managing flow of well fluids described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Reference will now be made in detail to the system for managing flow of well fluids. Methods of managing flow of well fluids will be subsequently described.

As used throughout this disclosure, "wellbore," may refer to a drilled hole or borehole extending from the surface of the Earth down to the geologic formation, including the open hole or uncased portion. The wellbore may form a pathway capable of permitting fluids to traverse between the surface and the geologic formation. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore.

As used throughout this disclosure, the terms "downward" and "upward" may refer to a position within a wellbore relative to the surface, with upward indicating direction or position closer to the surface and downward referring to direction or position farther away from the surface.

As described in the present disclosure, a "subsurface formation" may refer to a body of rock that is sufficiently distinctive and continuous from the surrounding rock bodies that the body of the rock may be mapped as a distinct entity. A subsurface formation is, therefore, sufficiently homogenous to form a single identifiable unit containing similar properties throughout the subsurface formation, including, but not limited to, porosity and permeability.

The systems may be implemented to transport fluids from or into various types of wells. For example, the system may be implemented to perform a flow-back operation, transporting well fluids out of a well to relieve elevated fluid pressure, which may be caused by, for example, fluid expansion, clogging, and other factors, rebuilding the pressure balance inside the well and/or between the well and the subsurface formation.

Figure 1A:
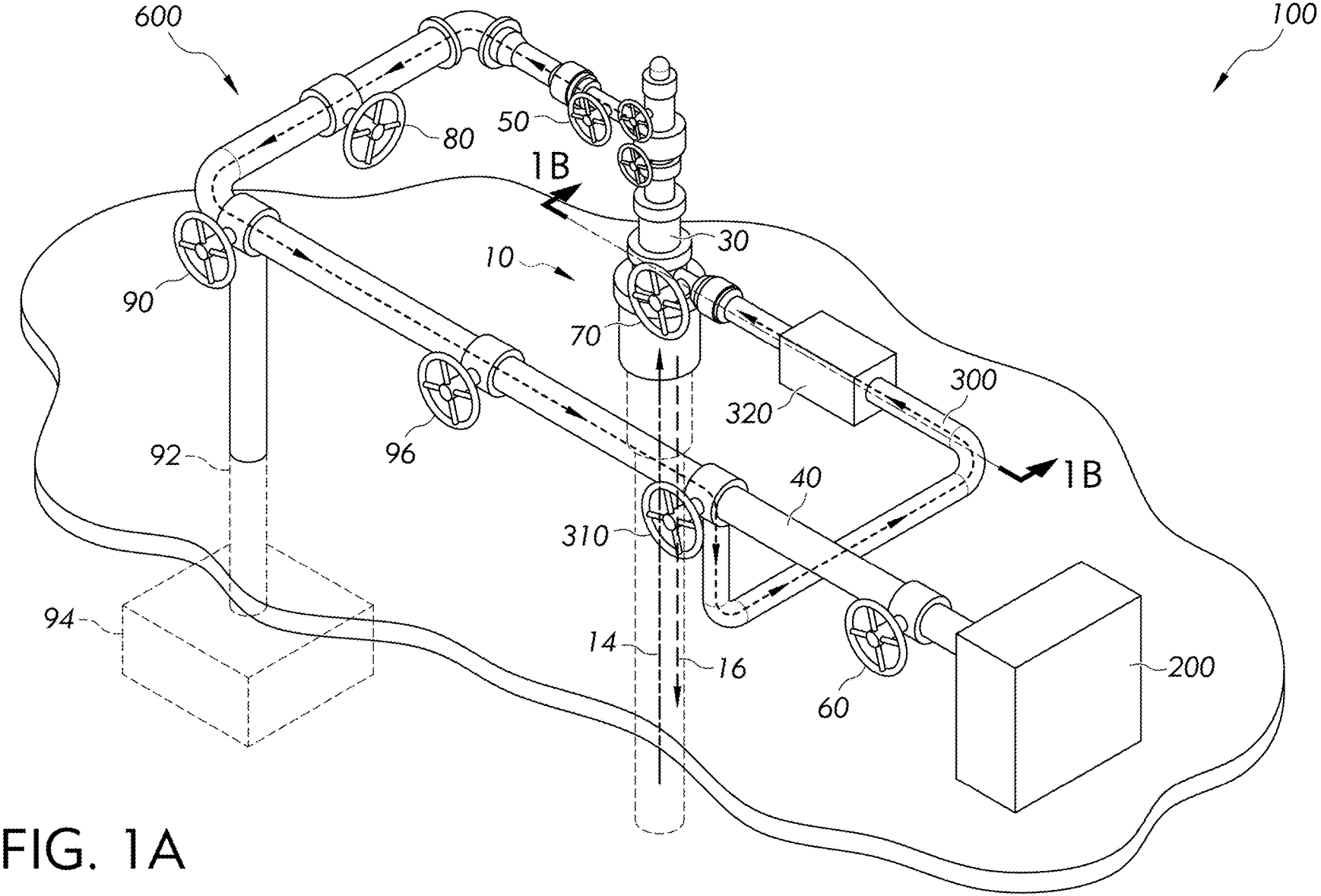
FIG. 1A is a schematic illustration of a system for managing well fluids in a well comprising a wellhead and a wellbore comprising an exemplary flow-back path, according to embodiments shown and disclosed herein.
Figure 1B:
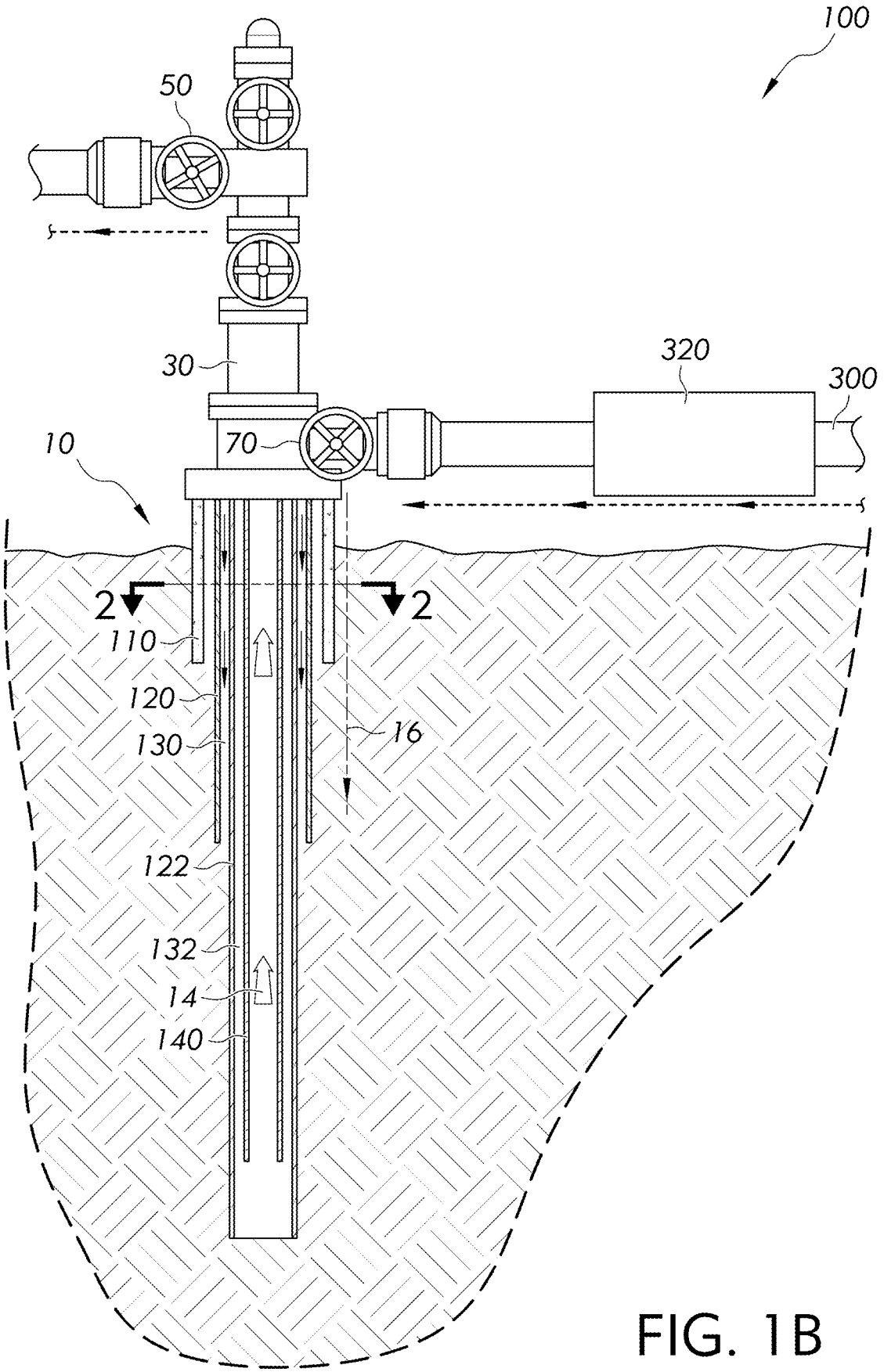
FIG. 1B is a view of the well of FIG. 1A, according to embodiments shown and disclosed herein.
Figure 2:
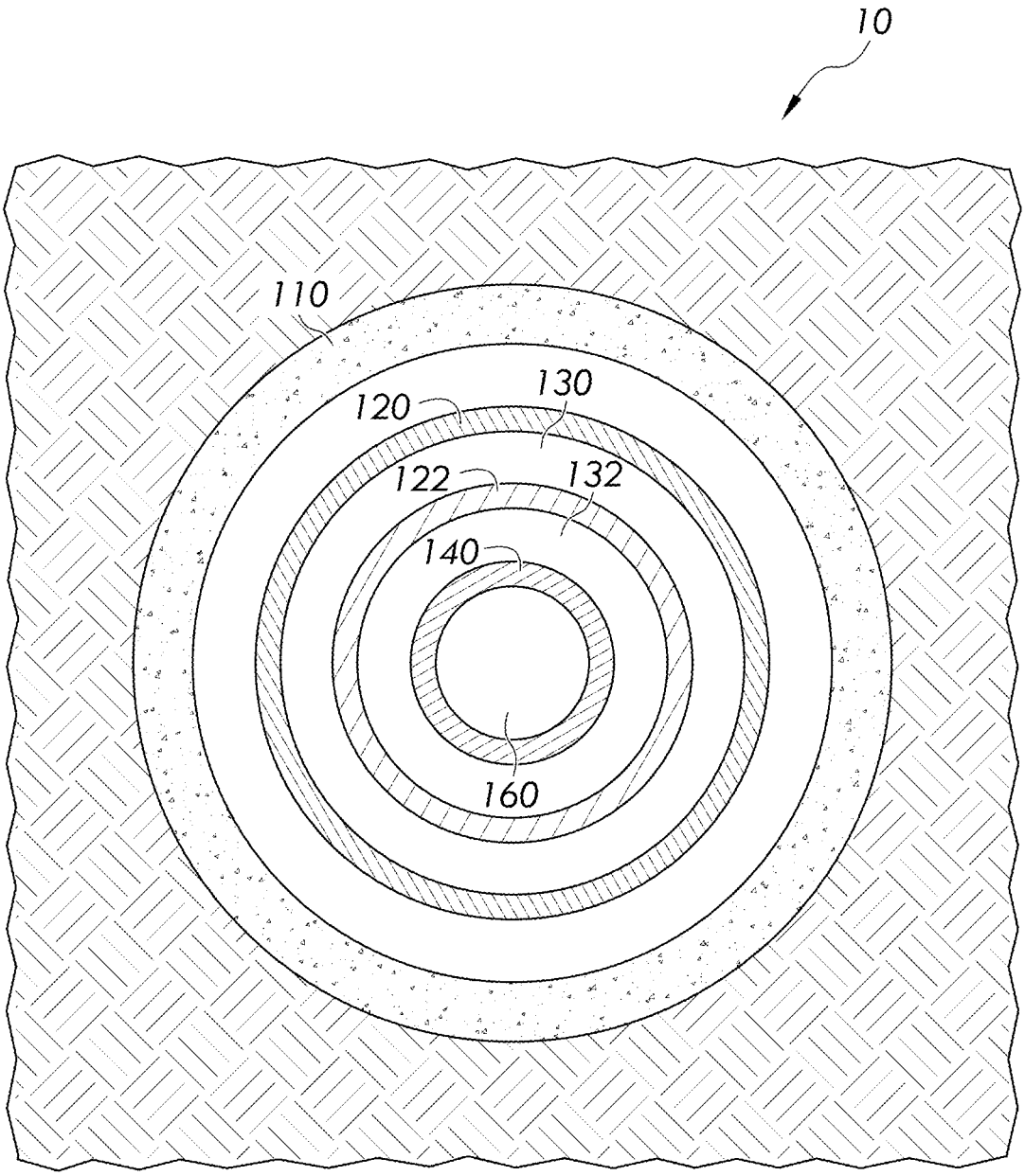
FIG. 2 is a top view of the wellbore of FIG. 1A, according to embodiments shown and disclosed herein.

Referring initially to FIG. 1A, FIG. 1B, and FIG. 2, a system (100) for managing flow of well fluids in a well (10) is provided. The well may comprise a wellhead (30) and a wellbore (110). The wellbore (110) may comprise a tubing (140) and a first casing (122) surrounding the tubing (140) and defining a tubing-first casing annulus (132). The wellbore may further comprise a second casing (120) surrounding the first casing (122) and defining a first casing-second casing annulus (130).

The system (100) includes a flow-back path (600). As shown in FIG. 1A, the flow-back path (600) may include the tubing (140) fluidly connected to the tubing-first casing annulus (132), a flow line (40) extending from the wellhead (30) to an injection source (200), and a recirculation line (300) extending from the flow line (40) to the wellhead (30).

In embodiments, and for example, the well (10) may be a packer-less injection well. As used herein, a "packer-less well" is a subsurface well bore completion assembly that does not have packer or sealing elements such as an inflatable or cup packer element. A packer-less well permits fluid movement across different zones (e.g. between annuluses or between an annulus and the tubing). In a packer-less well, the tubing-first casing annulus acts as a conduit for fluid injection. Without being bound by any particular theory, the tubing and tubing-first casing annulus pressure values may have a difference that is less than or equal to 200 psi, such as less than or equal to 150 psi, or less than or equal to 100 psi, or from 100 psi to 200 psi. In other embodiments, it is also contemplated that the methods described herein can be implemented in wells with packers functionalized to enable fluid movement across different zones by any conventional or yet-to-be-developed means recognized by one skilled in the art.

In embodiments, the well fluids may include hydrocarbons including oil and gas, water, oil/water emulsions, drilling and completion fluids, and/or stimulation fluids, and other solids or suspended solids such as oily solids, rock cuttings, sand particles, oily sludge, and/or tar.

In embodiments, the flow-back path (600) is operable to transport a portion of well fluids from the tubing (140) through the flow-back path (600) into the tubing-first casing annulus (132) during a flow-back operation. For example, the flow-back path (600) is operable to transport a portion of well fluids exiting the well (10) or moving uphole as outflow (14) and inject the well fluids back into the well (10) or movement downhole as inflow (16). In some embodiments, the flow-back operation may take place when a pressure in the wellhead (30) or the tubing (140) is greater than the pressure in the tubing-first casing annulus (132). In some other embodiments, the flow-back operation may take place when the pressure in the wellhead (30) or the tubing (140) exceeds a predetermined pressure-relief value. The transporting of well fluids may reduce the pressure in the wellhead (30) or the tubing (140) to a level at or below the predetermined pressure-relief value.

In embodiments, the flow-back path (600) is operable to transport greater than or equal to 90% of flow of the well fluids in the flow line (40) through the recirculation line (300) into the tubing-first casing annulus (132). In some embodiments, the flow-back path (600) is capable of discharging less than 10% of flow of the well fluids in the flow line (40) outside the flow-back path (600).

In some embodiments, the recirculation line (300) may include a stabilization system (320). The stabilization system may be configured to treat the well fluids before reinjecting the well fluids into the well (10). For example, the stabilization system may include a filtration unit capable of removing particles in the well fluids having a particle size of greater than or equal to 0.05 millimeters, such as greater than or equal to 0.01 millimeters, greater than or equal to 0.03 millimeters, greater than or equal to 0.10 millimeters or greater, 0.25 millimeters, greater than or equal to 0.50 millimeters, greater than or equal to 0.75 millimeters, or greater than or equal to 1.0 millimeters. During the filtration process, less than 10% of flow of the well fluids in the recirculation line (300) is discharged outside the system. Additionally, the stabilization system (320) may be configured to conduct at least one of the following: removing particles such as debris or sand; neutralizing the well fluid to a pH level of greater than or equal to 5.0 to less than or equal to 7.0; or both.

Various types of valves may be installed in the system to provide additional control of flow rate or flow pressure during a flow-back operation or other well fluid operation or to connect or adapt the system for other well fluid operations such as a clean-out operation. The various types of valves may include ball valves, globe valves, solenoid valves, butterfly valves, gate valves, control valves, check valves, conclusion valves that are commercially available or conventionally recognized by those skilled in the art.

In specific embodiments, the flow-back path (600) may comprise one or more valves.

The one or more valves may include a wing valve (50) provided as part of the wellhead (30) operable to fluidly connect or disconnect the flow line (40) and the tubing (140).

The one or more valves may include an extra casing valve (70) provided as part of the wellhead (30) operable to fluidly connect or disconnect the recirculation line (300) and the tubing-first casing annulus (132).

The one or more valves may include a circulation valve (310) provided as part of the flow line (40) operable to transport a portion of the well fluids from the flow line (40) through the recirculation line (300) and into the tubing-first casing annulus (132). The circulation valve (310) may be a three-way valve or a four-way valve operable to selectively fluidly connect or disconnect the flow line (40) to the recirculation line (300) and other fluid lines to establish at least one additional flow path, such as a flow-through path (620) that will be subsequently described. It is also contemplated that the circulation valve (310) may comprise at least one directional valves configured to divert flow of well fluids into the recirculation line and the at least one additional flow path, either alternately or concurrently.

The one or more valves may include a flow-line isolation valve (60) provided as port of the flow line (40) operable to fluidly connect or disconnect the flow line (40) and the at least one additional flow path (e.g. the flow-through path (620)) or other systems, such as the injection source (200).

The one or more valves may include a plot limit valve (96) operable to fluidly connect or disconnect the flow line (40) and both the recirculation line (300) and the at least one additional flow path connected to the circulation valve (310). A plot limit valve is a type of valve that may be implemented in control systems to regulate and limit the operation of other valves or devices. For example, it may work in conjunction with a pilot system, which controls the opening and closing of the valve based on specific set points or conditions. The plot limit valve may limit the flow, pressure, or other parameters within a desired range.

The one or more valves may include a kill valve (90) provided as port of the flow line (40) operable to fluidly connect or disconnect the flow line (40) and at least one additional fluid line or flow path, such as a waste disposal line (642), or a disposal path (640) that will be subsequently described. It is also contemplated that the kill valve (90) may comprise at least one directional valves configured to divert flow of well fluids through the flow line (40) or into the waste disposal line (642), either alternately or concurrently.

The one or more valves may include a flow control valve (80) provided as port of the flow line (40) operable to variably controls flow of the well fluids and/or injection fluids.

In further specific embodiments, the flow-back path (600) comprises the wing valve (50), the flow-line isolation valve (60), the extra casing valve (70), the flow control valve (80), the kill valve (90), the plot limit valve (96), and the circulation valve (310) disclosed and described herein.

Reference will now be made in detail to other flow paths that may be connected to the flow line (40).

As described in example embodiments, the flow-isolation valve (60) and/or the kill valve (90) may fluidly connect or disconnect the flow line (40) and other flow paths. For example, the quantity and the composition of well fluids may vary. Highly acidic fluids or heavy fluids may not be suitable for recirculation even after being treated. Excess well fluid may be redirected into other disposal reservoirs or injection sources once an annulus reaches its capacity.

Figure 3:
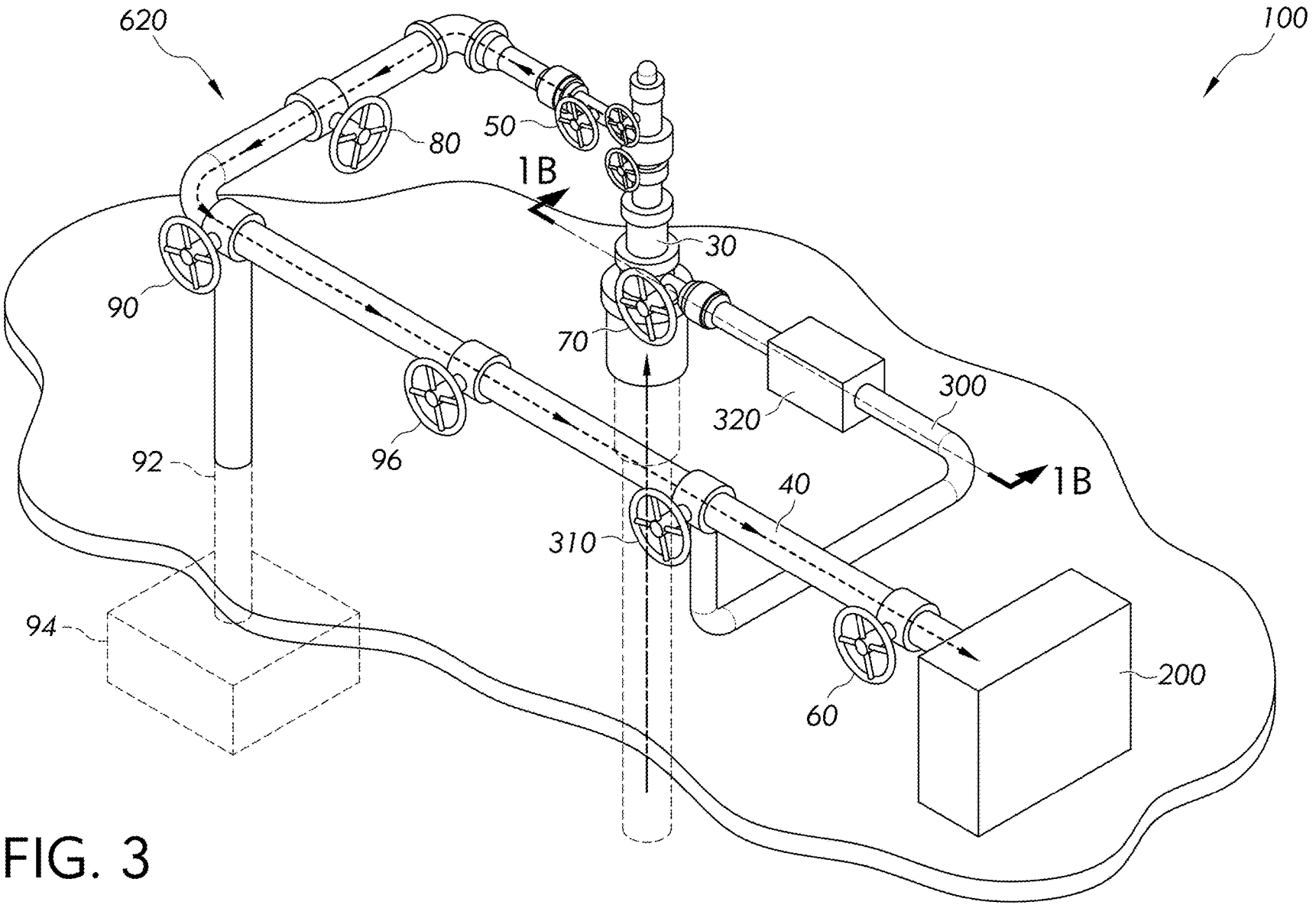
FIG. 3 is a schematic illustration of the system of FIG. 1 comprising an optional flow-through path, according to embodiments shown and disclosed herein.

Additionally or alternatively, referring to FIG. 3 and FIG. 2, the system may further comprise a flow-through path (620). In embodiments, the flow-through path (620) includes the tubing (140) fluidly connected to the injection source (200) through the flow line (40). The flow-isolation valve (60) described herein may be configured to fluidly connect or disconnect the flow line (40) and the injection source (200). In embodiments, the flow-through path (620) is operable to transport a portion of well fluids from the tubing (140) through the flow-through path (620) into the injection source (200) during a flow-back operation. In embodiments, the injection source (200) may be a gathering facility or plant.

Figure 4:
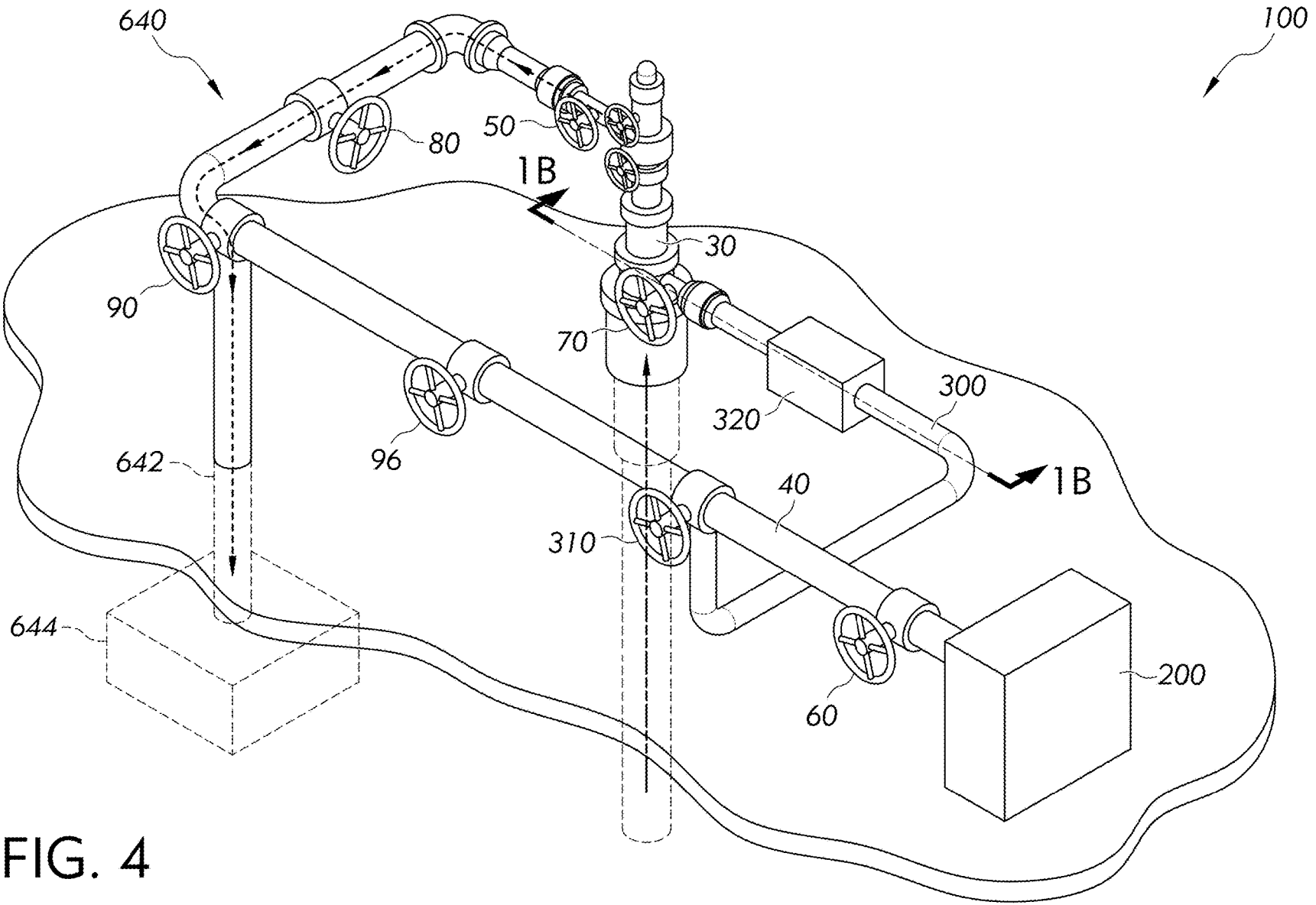
FIG. 4 is a schematic illustration of the system of FIG. 1 comprising an optional disposal path, according to embodiments shown and disclosed herein.

Additionally or alternatively, referring to FIG. 4 and FIG. 2, the system may further include a disposal path (640). In embodiments, the disposal path (640) includes the tubing (140) fluidly connected to a waste fluid reservoir (644), the flow line (40), and a waste-disposal line (642) extending from the flow line (40) to the waste fluid reservoir (644). The kill valve (90) described herein may be configured to fluidly connect or disconnect the flow line (40) and the waste-disposal line (642). In embodiments, the disposal path (640) is operable to transport a portion of well fluids from the tubing (140) through the disposal path (640) into the waste fluid reservoir (644) during a flow-back operation.

It is contemplated that, the flow-back path (600), the flow-through path (620), and the disposal path (640) described herein may be configured to be switchable between different paths described, to function as alternatives, allowing the fluid to be transported by only one of the three paths, or to function concurrently, enabling the fluid to be divided into portions and transported proportionally through one or more of the paths. For example, the kill valve (90) may be configured to transport heavy flow-back fluids or highly acidic flow-back fluids into the waste-disposal line (642) and the disposal reservoir and the plot limit valve (96), the circulation valve (310), and the flow-isolation valve (60) may be configured to stop the heavy flow-back fluids flowing into the recirculation line or other injection source (200). For examples, the kill valve (90) may be configured to direct a first portion of flow-back fluids into the waste-disposal line (640), the circulation valve (310) may be configured to direct a second portion of flow-back fluids into the recirculation line (300) and a third portion of flow-back fluids into the injection source (200).

Reference will now be made to methods of managing flow of well fluids in the well (10).

During a flow-back operation, and according to embodiments, the method may include measuring pressures in the wellhead (30), the tubing (140), or the tubing-first casing annulus (132); and transporting a portion of well fluids from the tubing (140) through the flow-back path (600) into the tubing-first casing annulus (132); through the flow-through path (620) into the injection source (200); and/or through the disposal path (640) into the waste fluid reservoir (644), when a pressure in the wellhead (30) or the tubing (140) is greater than the pressure in the tubing-first casing annulus (132) or when the pressure in the wellhead (30) or the tubing (140) exceeds a predetermined pressure-relief value. As noted herein, the transporting of well fluids out of the well may reduce the pressure in the wellhead (30) or the tubing (140) to a level at or below the predetermined pressure-relief value.

As used in this disclosure and in the appended claims, the words "comprise," "has," and "include" and all grammatical variations thereof are each intended to have an open, non-limiting meaning that does not exclude additional elements or steps.

As used herein, the singular forms "a," "an" and "the" include plural referents unless the context clearly dictates otherwise. Thus, for example, reference to "a" component includes aspects having two or more such components, unless the context clearly indicates otherwise.

It is also noted that recitations herein of "at least one" component, element, etc., should not be used to create an inference that the alternative use of the articles "a" or "an" should be limited to a single component, element, etc.

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component.

Furthermore, it is to be understood that the mere use of the term "first" and "second" does not require that there be any "third" component, although that possibility is contemplated under the scope of the present disclosure.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method of managing flow of well fluids in a well (10) comprising a wellhead (30) and a wellbore (110), the wellbore (110) comprising a tubing (140) and a first casing (122) surrounding the tubing (140) and defining a tubing-first casing annulus (132), the method comprising:

measuring pressures in the wellhead (30), the tubing (140), or tubing-first casing annulus (132);

transporting a portion of well fluids from the tubing (140) through a flow-back path (600), wherein the flow-back (600) comprises the tubing (140), a valve (50), a flow line (40) extending from the valve (50) to an injection source (200), and a circulation valve (310) provided as part of the flow line (40), the circulation valve (310) interposed between the wellhead (30) and the injection source (200), and the recirculation line (300) extending from the circulation valve (310) to the extra casing valve (70); and transporting the portion of well fluids from the tubing (140) through the circulation valve (310) and through the recirculation line (300) into the tubing-first casing annulus (132), rather than the injection source (200), when a pressure in the wellhead (30) or the tubing (140) is greater than the pressure in the tubing-first casing annulus (132) or when the pressure in the wellhead (30) or the tubing (140) exceeds a predetermined pressure-relief value, wherein the transporting of well fluids reduces the pressure in the wellhead (30) or the tubing (140) to a level at or below the predetermined pressure-relief value.

2. The method of claim 1, wherein greater than or equal to 90% of flow of the well fluids in the flow line (40) is transported through the recirculation line (300) into the tubing-first casing annulus (132) and less than 10% of flow of the well fluids in the flow line (40) is discharged outside the flow-back path (600).

3. The method of claim 1, wherein the recirculation line (300) comprises a stabilization system (320) removing particles in the well fluids having a particle size of greater than 0.05 millimeters and less than 10% of flow of the well fluids in the recirculation line (300).

4. The method of claim 1, further comprising:

transporting a portion of well fluids from the tubing (140) through a flow-through path (620) into an injection source (200) when the pressure in the wellhead (30) or the tubing (140) exceeds the predetermined pressure-relief value, wherein the transporting of well fluids reduces the pressure in the wellhead (30) or the tubing (140) to the level at or below the predetermined pressure-relief value, wherein:

the flow-through path (620) comprises the tubing (140) fluidly connected to the injection source (200) through the flow line (40).

5. The method of claim 4, wherein the flow-through path (620) comprises a flow-line isolation valve (60) provided as port of the flow line (40) operable to fluidly connect or disconnect the flow line (40) from the injection source (200).

6. The method of claim 4, wherein the injection source (200) is a gathering facility.

7. The method of claim 1, further comprising:

transporting a portion of well fluids from the tubing (140) through a disposal path (640) into a waste fluid reservoir (644) when the pressure in the wellhead (30) or the tubing (140) exceeds the predetermined pressure-relief value, wherein the transporting of well fluids reduces the pressure in the wellhead (30) or the tubing (140) to the level at or below the predetermined pressure-relief value, wherein:

the disposal path (640) comprises the tubing (140) fluidly connected to the waste fluid reservoir (644), the flow line (40), a waste-disposal line (642) extending from the flow line (40) to the waste fluid reservoir (644).

8. The method of claim 1, wherein the flow-back path (600) further comprises:

a flow control valve (80) provided as port of the flow line (40) operable to variably controls flow of the well fluids and/or injection fluids;

a kill valve (90) provided as port of the flow line (40) operable to fluidly connect or disconnect the flow line (40) to or from a waste disposal line (642);

a plot limit valve (96) operable to fluidly connect or disconnect the flow line (40) to or from the recirculation line (300) and the injection source 200; or combinations thereof.

9. The method of claim 1, wherein:

the valve (50) is a wing valve (50) and is operable to fluidly connect or disconnect the flow line (40) and the tubing (140); and the extra casing valve (70) is operable to fluidly connect or disconnect the recirculation line (300) and the tubing-first casing annulus (132).

10. A system for managing flow of well fluids in a well (10) comprising a wellhead (30) and a wellbore (110), the wellbore (110) comprising a tubing (140) and a first casing (122) surrounding the tubing (140) and defining a tubing-first casing annulus (132) and the wellhead (30) comprising a valve (50) fluidly connected to the tubing (140) as well as an extra casing valve (70) fluidly connected to the tubing-first casing annulus (132), the system comprising:

a flow-back path (600) comprising the tubing (140), the valve (50), a flow line (40) extending from the valve (50) to an injection source (200); a circulation valve (310) provided as part of the flow line, the circulation valve (310) interposed between the wellhead (30) and the injection source (200); and a recirculation line (300) extending from the circulation valve (310) to the extra casing valve (70), wherein:

the flow-back path (600) is operable to transport a portion of well fluids from the tubing (140) through the flow-back path (600), through the circulation valve (310), and through the recirculation line (300) into the tubing-first casing annulus (132) rather than the injection source (200) when a pressure in the wellhead (30) or the tubing (140) is greater than the pressure in the tubing-first casing annulus (132) or when the pressure in the wellhead (30) or the tubing (140) exceeds a predetermined pressure-relief value.

11. The system of claim 10, wherein the flow-back path (600) is operable to transport greater than or equal to 90% of flow of the well fluids in the flow line (40) through the recirculation line (300) into the tubing-first casing annulus (132) and discharge less than 10% of flow of the well fluids in the flow line (40) outside the flow-back path (600).

12. The system of claim 10, wherein the recirculation line (300) comprises a stabilization system (320) removing particles in the well fluids having a particle size of greater than 0.05 millimeters and less than 10% of flow of the well fluids in the recirculation line (300).

13. The system of claim 10, further comprising:

a flow-through path (620) comprising the tubing (140) fluidly connected to the injection source (200) through the flow line (40), wherein:

the flow-through path (620) is operable to transport a portion of well fluids from the tubing (140) through the flow-through path (620) into the injection source (200) during a flow-back operation.

14. The system of claim 13, wherein the flow-through path (620) comprises a flow-line isolation valve (60) provided as port of the flow line (40) operable to fluidly connect or disconnect the flow line (40) and the injection source (200).

15. The system of claim 10, further comprising:

a disposal path (640) comprising the tubing (140) fluidly connected to a waste fluid reservoir (644), the flow line (40), and a waste-disposal line (642) extending from the flow line (40) to the waste fluid reservoir (644), wherein:

the disposal path (640) is operable to transport a portion of well fluids from the tubing (140) through the disposal path (640) into the waste fluid reservoir (644) when the pressure in the wellhead (30) or the tubing (140) exceeds the predetermined pressure-relief value.

16. The system of claim 10, wherein the flow-back path (600) further comprises:

a flow control valve (80) provided as port of the flow line (40) operable to variably controls flow of the well fluids and/or injection fluids;

a kill valve (90) provided as port of the flow line (40) operable to fluidly connect or disconnect the flow line (40) and a waste disposal line (642);

a plot limit valve (96) operable to fluidly connect or disconnect the flow line (40) and both the recirculation line (300) and the injection source (200); or combinations thereof.

17. The system of claim 10, wherein:

the valve (50) is a wing valve (50) and is operable to fluidly connect or disconnect the flow line (40) and the tubing (140); and the extra casing valve (70) is operable to fluidly connect or disconnect the recirculation line (300) and the tubing-first casing annulus (132).

* * * * *